US008622132B2

(12) United States Patent
Coffey et al.

(10) Patent No.: US 8,622,132 B2
(45) Date of Patent: Jan. 7, 2014

(54) METHOD OF PERFORATING A WELLBORE

(75) Inventors: Nathan Brian Coffey, Grande Prairie (CA); Terry Lee Mytopher, Grande Prairie (CA)

(73) Assignee: Nine Energy Canada Inc.

( * ) Notice: Subject to any disclaimer, the term of this patent is extended or adjusted under 35 U.S.C. 154(b) by 397 days.

(21) Appl. No.: 12/804,517

(22) Filed: Jul. 23, 2010

(65) Prior Publication Data

US 2011/0017453 A1 Jan. 27, 2011

Related U.S. Application Data

(60) Provisional application No. 61/228,460, filed on Jul. 24, 2009, provisional application No. 61/230,468, filed on Jul. 31, 2009.

(51) Int. Cl.
*E21B 43/117* (2006.01)

(52) U.S. Cl.
USPC ..... 166/297; 166/55

(58) Field of Classification Search
USPC ..... 175/4.51, 4.54, 4.56, 4.57, 6; 166/297, 166/55; 102/306, 307, 308, 309, 310; 89/1.15
See application file for complete search history.

(56) References Cited

U.S. PATENT DOCUMENTS 2,980,017 A * 4/1961 Castel ..... 175/4.6
3,329,218 A * 7/1967 Bell ..... 175/4.54
4,299,287 A 11/1981 Vann et al.
4,756,371 A 7/1988 Brieger
4,794,990 A 1/1989 Riggs
4,969,525 A 11/1990 George et al.
5,449,039 A * 9/1995 Hartley et al. ..... 166/297
5,660,232 A 8/1997 Reinhardt
6,009,947 A 1/2000 Wilson et al.
6,220,355 B1 4/2001 French
6,386,288 B1 5/2002 Snider et al.
6,394,184 B2 * 5/2002 Tolman et al. ..... 166/281
6,536,524 B1 3/2003 Snider
6,557,636 B2 5/2003 Cernocky et al.
6,672,405 B2 1/2004 Tolman et al.
6,761,219 B2 7/2004 Snider et al.
6,962,202 B2 11/2005 Bell et al.
(Continued)

FOREIGN PATENT DOCUMENTS

CN 201187287 1/2009
RU 2185498 7/2002
RU 2185498 C1 * 7/2002

OTHER PUBLICATIONS

International Search Report for Patent Application No. PCT/IB2010/002163, dated Jan. 13, 2011 (8 pages).

*Primary Examiner* — William P Neuder
*Assistant Examiner* — Robert E Fuller

(57) ABSTRACT

The present invention discloses a wellbore subassembly with a perforating gun. The wellbore subassembly includes a tubular body and a perforating charge. The tubular body has a wall defining an interior space and an exterior space and the wall has a cavity. In some embodiments, the cavity may be shaped to define a charge socket that receives only a single perforating charge. The perforating charge is configured in the cavity at a location inside the wall. The perforating charge is configured to discharge toward and into the interior space and penetrate into the exterior space by perforating the wall across the interior space from the location of the perforating charge.

5 Claims, 10 Drawing Sheets

(56) References Cited

U.S. PATENT DOCUMENTS 7,152,676 B2 12/2006 Vella et al.
7,461,580 B2 12/2008 Bell et al.
7,621,342 B2 * 11/2009 Walker ..... 175/4.55
8,151,882 B2 * 4/2012 Grigar et al. ..... 166/278

* cited by examiner

METHOD OF PERFORATING A WELLBORE

CROSS REFERENCE TO RELATED APPLICATION

This application is a continuation-in-part application that is related to and claims the benefit of Provisional Application No. 61/228,460, filed Jul. 24, 2009, and Provisional Application No. 61/230,468, filed Jul. 31, 2009, both entitled "Downhole Sub with Perforating Gun" which are incorporated herein by reference in their entirety.

TECHNICAL FIELD

The present invention relates to the field of wellbore subassemblies with perforating guns.

BACKGROUND

A wellbore generally refers to a hole drilled into the earth for the extraction of hydrocarbon-based materials such as, for example, oil and natural gas. Because the term "wellbore" generally includes the openhole or uncased portion of a well, the term "wellbore" typically refers to the space bounded by the wellbore wall—that is, the face of the geological formation that bounds the drilled hole. A wellbore is sometimes referred to as a "borehole."

A perforation is the communication tunnel created from the casing or liner into the reservoir formation, through which oil or gas is produced. The most common method of perforating uses jet perforating guns equipped with shaped explosive charges. However, other perforating methods include bullet perforating, abrasive jetting or high-pressure fluid jetting. Perforation density is the number of perforations per linear foot. The term perforation density is used to describe the configuration of perforating guns or the placement of perforations, and is often abbreviated to spf (shots per foot). An example would be an 8 spf perforating gun. Perforation penetration is a measure, or indicator, of the length that a useable perforation tunnel extends beyond the casing or liner into the reservoir formation. In most cases, a high penetration is desirable to enable access to that part of the formation that has not been damaged by the drilling or completion processes. Perforation phasing is the radial distribution of successive perforating charges around the gun axis. Perforating gun assemblies are commonly available in 0-, 180-, 120-, 90- and 60-degree phasing. The 0-degree phasing is generally used only in small outside-diameter guns, while 60, 90 and 120 degree phase guns are generally larger but provide more efficient flow characteristics near the wellbore.

A perforating gun is a device used to perforate oil and gas wells in preparation for well production. Such guns typically contain several shaped explosive charges and are available in a range of sizes and configurations. The diameter of the gun used is typically determined by the presence of wellbore restrictions or limitations imposed by the surface equipment. The perforating gun, fitted with shaped charges or bullets, is lowered to the desired depth in a well and fired to create penetrating holes in casing, cement, and formation. Thus, to perforate is to pierce the casing wall and cement of a wellbore to provide holes through which formation fluids may enter or to provide holes in the casing so that materials may be introduced into the annulus between the casing and the wall of the borehole.

Current drilling has focused more on directional drilling. Directional drilling results in the creation of lateral well bores. Lateral well bores create many difficulties including difficulties with respect to perforating. It is appreciated that arcuate and lateral portions of a well bore create specific problems, especially with respect to perforating. Further, the longer the lateral portions of the well bore, the more difficult it is to achieve effective perforations. Thus, as drilling practices are directed more toward directional drilling, and directional drilling creates more and longer lateral well bores, the need for effective perforating techniques is greatly increased. The need for effective perforating techniques has long existed and the need increases proportionately with the increase in directional drilling.

There has been a long felt need to perforate accurately and efficiently. The types of charges available have restricted such perforating. The available charges are a restriction to enhancing the performance of the perforation.

The characteristics of the perforation have been and continue to be inferior. Particularly, the need for a continuous, normal perforation, free from disruption, has long been sought after, but not achieved.

The ability to enhance the performance of the perforation has long eluded the art. Especially, the ability to assist and aid the existing charges in the enhancement of the capacity and forcefulness of the perforation has long been desired.

Current perforating practices require much equipment and manpower. For example, the use of coil tubing to initiate the perforating process is costly, time consuming, laden with the need for manpower, and prone to have safety problems.

Current perforating devices adapted during casing installation are problematic. Such perforating devices require secondary control lines that extend to the surface, and are tedious to install and use. It is long desired to have a "disappearing" perforating gun that is unobtrusive after it has been used.

BRIEF DESCRIPTION OF DRAWINGS

The accompanying drawings, which are incorporated in and constitute a part of this specification, illustrate an implementation of apparatus consistent with the present invention and, together with the detailed description, serve to explain advantages and principles consistent with the invention. In the drawings, FIG. 1 sets forth a drawing illustrating a top orthogonal view of a wellbore subassembly with perforating gun according to embodiments of the present invention.

DESCRIPTION OF EMBODIMENTS

Figure 1:
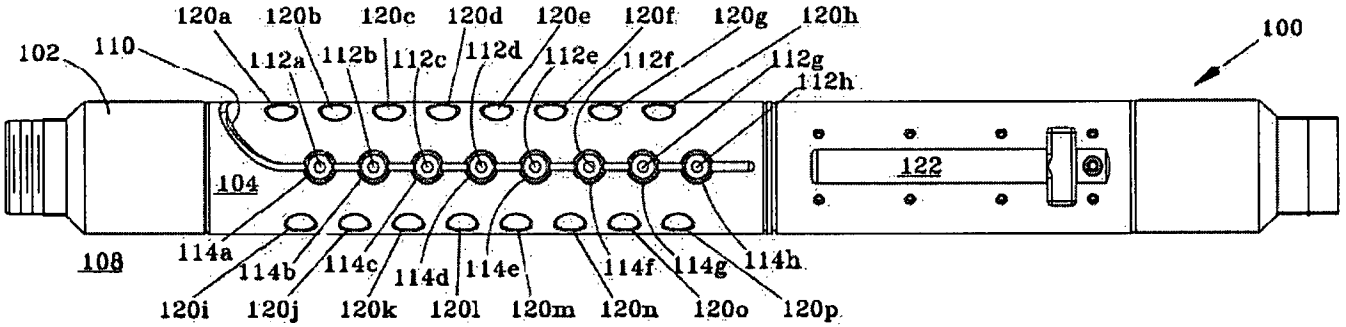

Exemplary embodiments of a wellbore subassembly with perforating gun are described herein with reference to the accompanying drawings, beginning with FIG. 1. FIG. 1 sets forth a drawing illustrating a top orthogonal view of a wellbore subassembly (100) with perforating gun according to embodiments of the present invention.

The wellbore subassembly (100) of FIG. 1 is a device that may be convey along a tubular string through a wellbore and used to perforate a geological formation adjacent to the wellbore at the location of the wellbore subassembly (100). The tubular string on which the wellbore subassembly (100) of FIG. 1 is conveyed may be a casing string, a liner, a coiled tubing string, or any other tubular structure conveyed through a wellbore as will occur to those of skill in the art. The purpose of perforating the geological formation is to create fractures that assist in increasing the communication conductivity of hydrocarbon-based materials from the geological formation to the wellbore and then in turn to the surface.

The wellbore subassembly (100) of FIG. 1 includes a tubular body (102) having a tubular wall (104). The tubular wall (104) of the exemplary wellbore subassembly (100) in FIG. 1 separates and defines two spaces—an interior space (not shown) along the inside of the tubular body (102) and an exterior space (108) surrounding the outside of the tubular body (102). The tubular body (102) in the example of FIG. 1 is configured in a cylindrical shape because many wellbore components utilize this shape, but other shapes as will occur to those of skill in the art may also be useful. In the example of FIG. 1, the tubular body (102) is primarily designed out of a strong, but lightweight material, such as for example, aircraft aluminum. One skilled in the art, however, will recognized that other materials may also be useful in wellbore subassemblies according to embodiments of the present invention such as, for example, other types of aluminum, steel, carbon-based materials, and so on.

Because the wellbore subassembly (100) of FIG. 1 is typically configured as part of a tubular string, the interior space (not shown) of the wellbore subassembly (100) may be used to convey the variety of materials that typically pass through a tubular string during the lifecycle of a well. Such materials include, for example, water, treatment fluids, frac gels, hydrocarbons, or any other materials as will occur to those of skill in the art.

The exterior space (108) of FIG. 1 is the region surrounding the wellbore subassembly (100) and may include the adjacent geological formation. The exterior space (108) of FIG. 1 may also include any intervening structures between the wall (104) and the geological formation, including any additional tubular walls from strings through which the wellbore subassembly (100) is conveyed, any pockets of air or fluid in the annulus between the wall (104) and the geological formation. In many embodiments, the tubular string on which the wellbore subassembly (100) of FIG. 1 is conveyed is cemented in place. That is, cement fills the annulus between the wall (104) and the geological formation. In such embodiments, the exterior space (108) also includes this cement annulus and the adjacent geological formation.

In the example of FIG. 1, the tubular wall (104) has a cavity (110) for holding perforating charges (112) and a detonation cord (not shown). The detonation cord connects the charges (112) to a firing assembly (not shown, discussed below) that is installed in the firing assembly recess (122). The exemplary tubular body (102) of FIG. 1 includes only one cavity (110) and that cavity (110) is configured in an "S" pattern that runs longitudinally along the length of the tubular body (102). This "S" patterned cavity (110) in FIG. 1 is shaped to define three rows of charge sockets (114). In the view of FIG. 1, however, only one row of the charge sockets is visible—namely, the row of charge sockets (114*a-h*).

Each charge socket (114) of FIG. 1 is cylindrical in shape slightly larger than the perforating charge (112) that will be configured inside the socket (114). Each socket (114) of FIG. 1 receives and holds only one perforating charge (112), and in this manner, each charge sockets (114) isolates its corresponding perforating charge (112) from the others charges to minimize interference among the charges (112) as the charges (112) detonate. In the example of FIG. 1, the shape of the sockets (114) themselves also operate to minimize detonation interference among the charges (112) because walls of each socket (114) assist in channeling the explosive forces from each perforating charge (112) radially inward toward the center of the wellbore subassembly (100) rather than permitting the explosive forces to flow laterally along the longitudinal length of the tubular body (102).

During the assembly of the wellbore subassembly (100) of FIG. 1, the perforating charges (112) are typically inserted into the charge sockets (114) and held in place by frictional forces, O-ring gaskets, or other ways as will occur to those skilled in the art. A detonation cord is then run from the firing assembly (discussed below) along the cavity (110) and across the top of the charges (112).

Although not shown in FIG. 1, the tubular wall (104) also includes a removable outer layer (not shown, discussed below) that fits around the portion of the tubular body (102) containing the perforating charges (112). This removable exterior sleeve covers the cavity (110) from the exterior space (108) and protects the charges (112) from conditions in the exterior space (108). In addition, the removable outer layer may also operate to keep the charges and detonation cord in place inside the cavity (110).

The wellbore subassembly (100) of FIG. 1 includes a plurality of perforating charges (112). Each perforating charge (112) of FIG. 1 is configured in the cavity (110) at a location inside, that is within, the wall (104). The perforating charges (112) of FIG. 1 are shaped charges that channel the explosive forces in the direction of the center of the tubular body (102). That is, the perforating charges (112) of FIG. 1 are configured to discharge toward the interior space (not shown) and penetrate into the exterior space (108) by perforating the wall (104) across the interior space from the location of the perforating charge (112) defined as the target wall. In this manner, each charge (112) discharges toward and into the interior space and out through the other side via the target wall of the wellbore subassembly (100) into the exterior space (108). This discharge configuration creates a straight path, free from irregularities and well defined, through the tubular wall (104) for communicating fluids, gases, or other materials between the interior space of the wellbore subassembly (100) and the exterior space (108).

In the example of FIG. 1, the wellbore subassembly (100) also includes exit cavities (120) designed to reduce the thickness of the wall (104) where the perforating charges (112) penetrate into the exterior space (108). The exit cavities (120) of FIG. 1 effectively thin the amount of the wall (104) that the charges (112) must perforate before penetrating into the exterior space (108) and allow more energy from the detonation to reach the exterior space (108). This results in deeper penetrations into the adjacent geological formation. Each exit cavity (120) in the example of FIG. 1 corresponds to and is shaped similar to one of the charge sockets (114). Each exit cavity (120) of FIG. 1 is cylindrical in shape and is located in the wall (104) across the interior space from the location of its corresponding charge socket (114) and perforating charge (112). In FIG. 1, the exit cavities (120*a-h*) correspond to charges and charge sockets that are not visible from the view of FIG. 1 because those charges and charge sockets are on the opposite side of the wellbore subassembly (100). The exit cavities (120*i-p*) also correspond to charges and charge sockets that are not visible in FIG. 1. Similarly, while charges (112*a-h*) and charge sockets (114*a-h*) are visible in FIG. 1, the corresponding exit cavities are not visible because they are on the opposite side of the wellbore subassembly (100). One skilled in the art, however, will note that none of the charge sockets (114) or the exit cavities (120) would actually be visible from a mere outside inspection of the wellbore subassembly (100) because the portion of the tubular body (102) in FIG. 1 configured with the charge sockets (114) and exit cavities (120) includes a removable outer layer (118) that protects those features from the exterior space (108). It is also appreciated that the density of the material associated with the exit cavities and/or the target wall can be changed to provide and enhanced perforation.

As mentioned above, the perforating charges (112) and the detonation cord (not shown), which are conveyed along the cavity (110), connect to a firing assembly (not shown) that is mounted in the firing assembly recess (122). The firing assembly recess (122) of FIG. 1 is implemented as a slot in the wall (104) oriented longitudinally along the tubular body (102). The firing assembly recess (122) of FIG. 1 is connected to the cavity (110) through a hollowed passage (not shown) in the wall (104). In FIG. 1, the firing assembly recess (122) is configured to receive a firing assembly oriented longitudinally along the tubular body (102). The firing assembly is secured in the firing assembly recess (122) of FIG. 1 using an exterior sleeve (not shown) that is described further with reference to FIG. 10 below. In other embodiments, the firing assembly may be secured in the firing assembly recess (122) using clamps such as those clamps described further with reference to FIG. 11 below.

Figure 2:
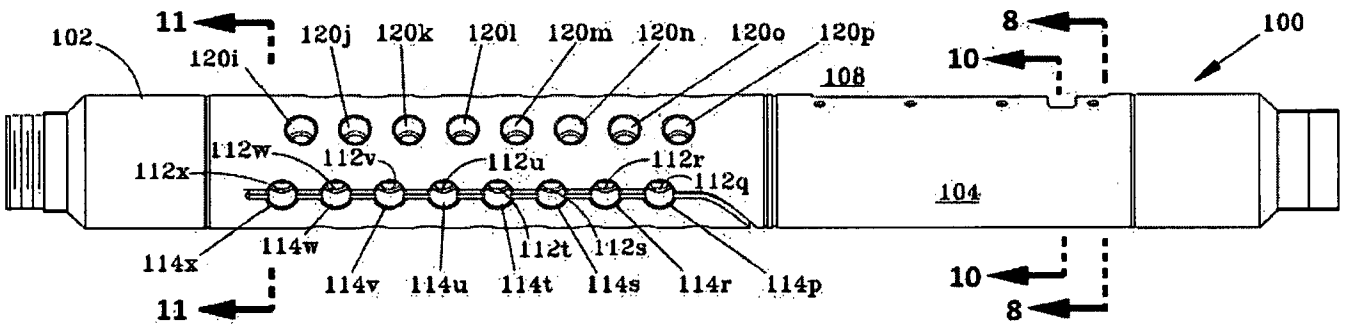
FIG. 2 sets forth a drawing illustrating an elevation view of the wellbore subassembly with perforating gun according to embodiments of the present invention.

FIG. 2 sets forth a drawing illustrating an elevation view of the wellbore subassembly (100) with perforating gun according to embodiments of the present invention. The view of the wellbore subassembly (100) in FIG. 2 illustrates the third row of charge sockets (114*q-x*) configured in the cavity (110) and also illustrates exit cavities (120*i-p*). Each charge socket (114*q-x*) receives a single perforating charge (112) and corresponds with one of the exit cavities (120*a-h*) depicted in FIG. 1. For example, the charge socket (114*x*) corresponds with exit cavity (120*a*) from FIG. 1 because the perforating charge (112*x*) in the socket (114*x*) is directed to penetrate the wall (104) at the location of the exit cavity (120*a*) in FIG. 1 across the interior space of the tubular body (102).

Figure 3:
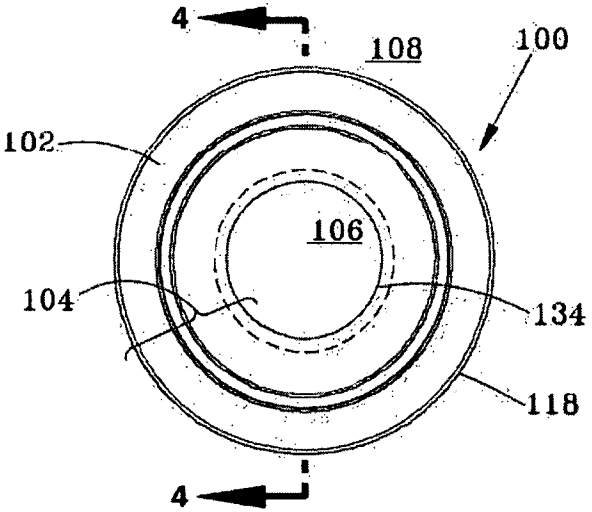
FIG. 3 sets forth a drawing illustrating a left orthogonal view of the wellbore subassembly with perforating gun according to embodiments of the present invention.

Turning to FIG. 3, FIG. 3 sets forth a drawing illustrating a left orthogonal view of the wellbore subassembly (100) with perforating gun according to embodiments of the present invention. FIG. 3 depicts the tubular body (102) formed from a cylindrical wall (104). The wall of FIG. 3 defines an interior space (106), depicted as an interior bore extending longitudinally through the tubular body (102), and an exterior space (108). In the example of FIG. 3, the tubular body (102) includes a removable outer layer (118) that covers the cavity (not shown) from the exterior space (108). The tubular body (102) of FIG. 3 also includes an inner liner (134) configured along the tubular body (102) between the sockets (not shown) of the cavity and the interior space (106). The inner liner (134) of FIG. 3 separates the charge sockets from the interior space (106).

Figure 4:
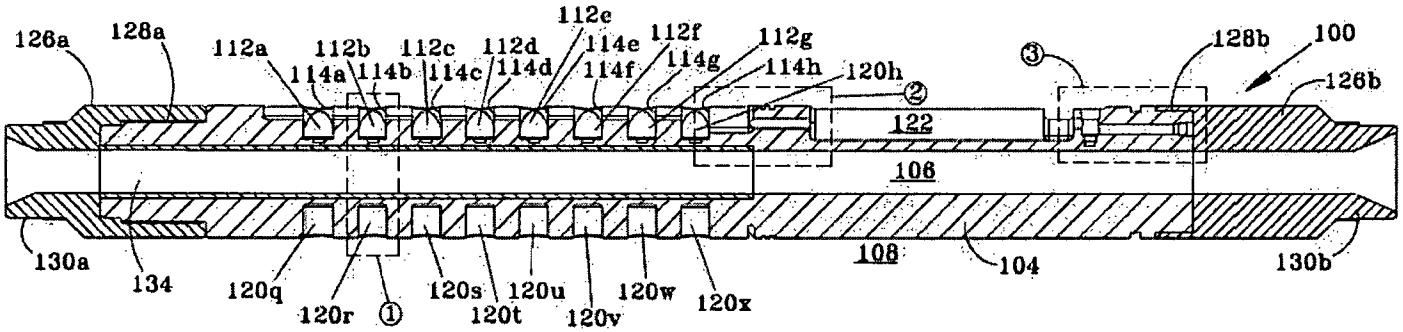
FIG. 4 sets forth a drawing illustrating the 4-4 sectional view of the wellbore subassembly with perforating gun according to embodiments of the present invention from FIG. 3.

FIG. 4 sets forth a drawing illustrating the 4-4 sectional view of the wellbore subassembly (100) with perforating gun according to embodiments of the present invention from FIG. 3. The wellbore subassembly (100) of FIG. 4 includes a tubular body (102) that has a wall (104) defining an interior space (106) and an exterior space (108). The wall (104) of FIG. 4 has a cavity (110) that is shaped to define a plurality of charge sockets (114). The cavity (110) connects to the firing head recess (122) via a hollowed passage through the wall (104) of the tubular body (102). The manner in which the firing head assembly in the firing head recess (122) ignites the detonation cord, and in turn detonates the perforating charges, is discussed further below with reference to FIGS. 6 and 7. Further, FIG. 4 illustrates the exit cavities (120) corresponding to the charge sockets (114). The exit cavity (120) can have therein or associated therewith an accelerator or performance enhancer to provide a cleaner perforation tunnel, as well as a longer, bigger and better defined fraction or perforation. The accelerator or performance enhancer can be any appropriate stimulator, such as for example, a jet fuel product. Further, the accelerator or performance enhancer can be in any form, such as for example, a solid, liquid, wax or combinations thereof. Such an accelerator or performance enhancer can be built into the exit cavity (120), can be placed in the exit cavity (120), or associated with the exit cavity (120) so as to provide a cleaner perforation tunnel, as well as a longer, bigger and better defined fraction or perforation.

In the example of FIG. 4, the tubular body (102) includes an inner liner (134). The inner liner (134) is configured longitudinally along the length of the tubular body (102) between the cavity (110) and the interior space (106). The inner liner (134) of FIG. 4 is cylindrical in shape and forms part of the wall (104) defining the interior space (106). The sides of the inner liner (134) in FIG. 4 are generally flat, thereby making the cross-section of the sides of the inner liner (134) rectangular in shape. One skilled in the art, however, will recognize that the wall of the inner liner (134) may be formed in a variety of geometric configurations to enhance structural support along different areas of the tubular body (102).

In some embodiments, the cavity (110) may extend at various locations through the wall (104) to the inner liner (134) such as, for example, at the charge sockets (114). In such embodiments, when the perforating charge (112) first penetrates into the interior space (106), it need only pass through the inner liner (134). In other embodiments, however, the cavity (110) may not extend through the wall (104) all the way to the inner liner (134). In those embodiments, the perforating charge (112) must first penetrate through a portion of the wall material forming the cavity (110) as well as the inner liner (134) before reaching the interior space (106).

The inner liner (134) of FIG. 4 extends along the tubular body (102) at the portion of the tubular body (102) containing the perforating charges (112). One skilled in the art, however, will recognize that the inner liner (134) may extend along the entire length of the tubular body (102) or merely a portion of the tubular body (102). The inner liner (134) of FIG. 4 operates to reduce interference among the perforating charges (112) as the charges (112) detonate serially. This interference may occur because, as each charge (112) detonates, the pressure from the detonation may deform nearby charge sockets. Accordingly, any undetonated charges in those nearby sockets may not fire completely along the intended path directly through the interior space (106) and out of the other side of the wellbore subassembly (100). This misdirected detonation reduces the effectiveness of the charge (112) at penetrating into the exterior space (108). The inner liner (134) of FIG. 4 reduces the interference among the perforating charges (112) by reinforcing the charge sockets (114). The inner liner (134) of FIG. 4 is made of a harder material than the portion of the tubular body (102) forming the cavity (110). For example, the inner liner (134) of FIG. 4 may be made of a material such as steel. In contrast, the other portions of the tubular body (102) may be configured from aluminum or other materials that are relatively lightweight, but become brittle and susceptible to deformation at high pressures such as may occur during a charge detonation. When the tubular body (102) is implemented entirely using a material, such as for example steel, which is not typically subject to the deformation that would diminish the effectiveness of the perforating charges (112), one skilled in the art will recognize that an inner liner may not provide any advantages.

The tubular body (102) in the example of FIG. 4 includes two interchangeable end adapters—an interchangeable end adapter (126*a*) on the left end of the tubular body (102) and an interchangeable end adapter (126*b*) on the right end of the tubular body (102). These interchangeable end adapters allow the wellbore subassembly (100) to be conveyed along tubular strings of varying sizes or that connect with the wellbore subassembly (100) using different types of interfaces such as, for example, different types of screw threads. Each interchangeable end adapter (126) has a first interface (128) for connecting to the other portions of the tubular body (102) and has a second interface (130) for connection to a tubular string along which the wellbore assembly (100) is conveyed. In example of FIG. 4, the interchangeable end adapter (126*a*) on the left side of the tubular body (102) includes the first interface (128*a*) that is implemented using a screw thread that matches the screw thread of the portion of the tubular body (102) to which the interchangeable end adapter (126*a*) connects.

The second interface (130*a*) of the interchangeable end adapter (126*a*) in the example of FIG. 4 is also implemented using a screw thread. The screw thread of the second interface (130*a*) matches the screw thread of the next component in the tubular string along which the wellbore subassembly (100) is conveyed. The interchangeable end adapter (126*b*) on the right side of the tubular body (102) includes a first interface (128*b*). The first interface (128*b*) is implemented using a screw thread that matches the screw thread of the portion of the tubular body (102) to which the interchanged end adapter (126*b*) connects. The interchangeable end adapter (126*b*) of FIG. 4 also includes a second interface (130*b*) that is implemented using a screw thread that matches the screw thread of the next component of the tubular string along which the wellbore subassembly (100) is conveyed.

Figure 5:
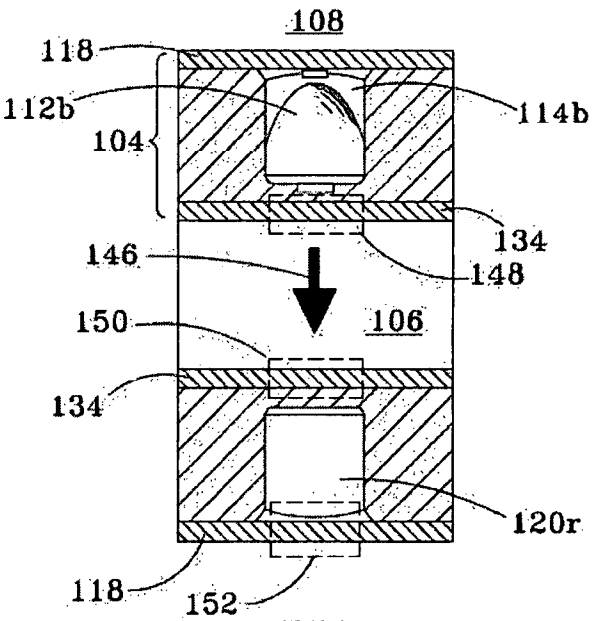
FIG. 5 sets forth a drawing illustrating a detailed view of region one of the wellbore subassembly with perforating gun according to the embodiments of present invention from FIG. 4.

FIG. 5 sets forth a drawing illustrating a detailed view of region one of the wellbore subassembly (100) with perforating gun according to the embodiments of present invention from FIG. 4. In the example of FIG. 5, the perforating charge (112*b*) is configured in charge socket (114*b*) at a location within the wall (104). At a location along the wall (104) across the interior space (106) from the location of the perforating charge (112*b*), the wall (104) is configured with an exit cavity (120*r*).

The perforating charge (112*b*) in example of FIG. 5 is protected from the exterior space (108) by the removable outer layer (118). To protect the socket (114*b*) and the charge (112*b*) from deformation due to the pressure created in the interior space (106) from the other detonating charges in the wall (104), the wall (104) includes inner liner (134) made of a material, such as for example steel, that reinforces socket (114*b*) to withstand the forces created from the other detonating charges. In the example of FIG. 5, the perforating charge of (112*b*) is a shaped charge that detonates inwardly toward the interior space (106) and perforates the wall (104) at a location across the interior space (106) from the location of the perforating charge (112*b*) and penetrates into the exterior space (108). That is, in the example of FIG. 5, the perforating charge detonates along the direction of arrow (146). Upon detonation, therefore, the perforating charge (112*b*)

penetrates the inner liner (134) at specific regions (148, 150) and then continues through the wall (104) to penetrate the removable outer layer (118) at another region (152). The intermediate region (150) can be defined as the wall target.

Figure 6:
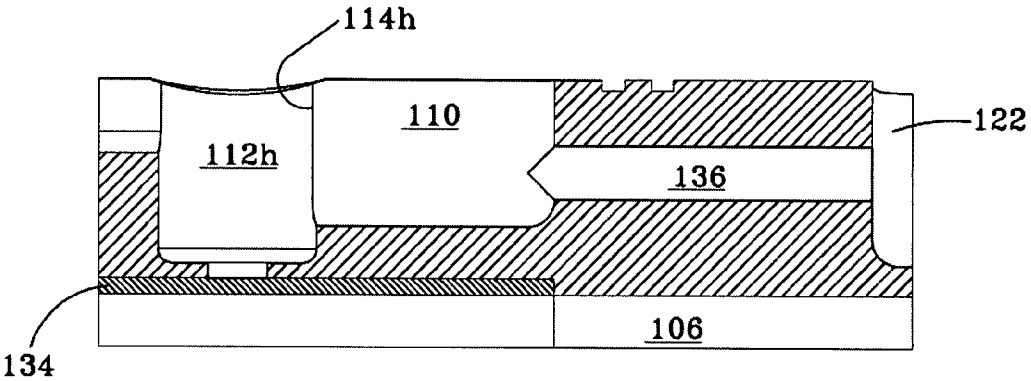
FIG. 6 sets forth a drawing illustrating a detailed view of region two of the wellbore subassembly with perforating gun according to the embodiments of present invention from FIG. 4.

As mentioned above, perforating charges (112) in the wellbore subassembly (100) according to embodiments of the present invention are ignited via a detonation cord that connects to a firing head assembly in the firing head recess (122). For further explanation, therefore, FIG. 6 sets forth a drawing illustrating a detailed view of region two of the wellbore subassembly (100) with perforating gun according to the embodiments of present invention from FIG. 4. In the example of FIG. 6, the cavity (110) is configured to form charge socket (114*h*), and the perforating charge (112*h*) is seated in the socket (114*h*) of FIG. 6. A detonation cord (not shown) is extended across the top of the perforating charge (112*h*) along the cavity (110) and is configured through the hollowed passageway (136) to the firing assembly recess (122) where the detonation cord connects to the firing head assembly (not shown). Further, FIG. 5 illustrates the exit cavities (120) corresponding to the charge sockets (114). The exit cavity (120) can have therein or associated therewith an accelerator or performance enhancer to provide a cleaner perforation tunnel, as well as a longer, bigger and better defined fraction or perforation. The accelerator or performance enhancer can be any appropriate stimulator, such as for example, a jet fuel product. Further, the accelerator or performance enhancer can be in any form, such as for example, a solid, liquid, wax or combinations thereof. Such an accelerator or performance enhancer can be built into the exit cavity (120), can be placed in the exit cavity (120), or associated with the exit cavity (120) so as to provide a cleaner perforation tunnel, as well as a longer, bigger and better defined fraction or perforation.

It has been found that the configuration of the charge socket (114), the interior space (106) and the exit cavity (120) creates a focused discharge that greatly enhances the resulting explosive characteristics. There is a volume of gas and air that expands when the charges (112) ignite. This natural expansion of gas and air provides additional explosive characteristics.

Further, it has been found that the structure and/or configuration of the charge socket (114) enhances the explosive characteristics associated with the present disclosure. The structure and/or configuration of the charge socket (114) confines the explosive charge characteristics thereby increasing the charge performance.

Figure 7:
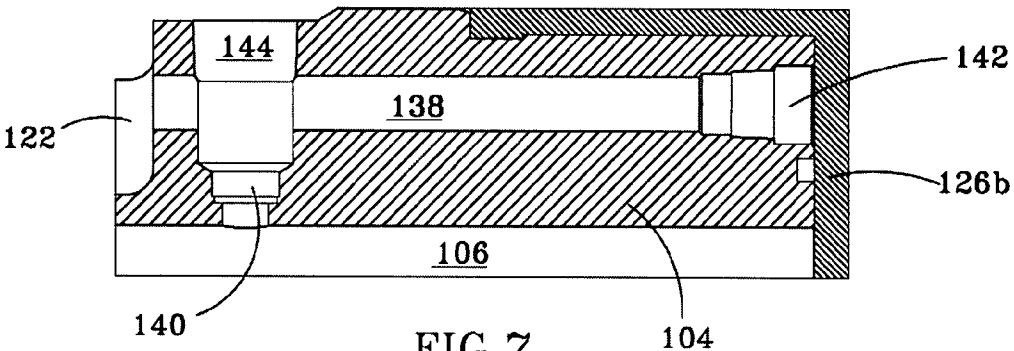
FIG. 7 sets forth a drawing illustrating a detailed view of region three of the wellbore subassembly with perforating gun according to the embodiments of present invention from FIG. 4.

For further explanation of the manner in which the firing head assembly is detonated, FIG. 7 sets forth a drawing illustrating a detailed view of region three of the wellbore subassembly (100) with perforating gun according to the embodiments of present invention from FIG. 4. The firing head assembly that is positioned in the firing recess (122) in the example of FIG. 7 is actuated by fluid pressure in the interior space (106). The fluid pressure in the interior space (106) is typically controlled by the well operator at the surface of the well. Varying the pressure applied to the tubular string at the surface varies the pressure in the interior space (106) of the wellbore subassembly (100), which is a component of the tubular string.

In the example of FIG. 7, the pressure of the interior space (106) is communicated to the firing head assembly in the firing assembly recess (122) through hollowed passage (138) and through burst disc (140). The burst disc (140) of FIG. 7 is designed as a pressure barrier between the interior space (106) and the hollowed passage (138). When the pressure differential between the interior space (106) and hollowed passage (138) exceeds a predetermined threshold, the burst disc (140) ruptures, thereby communicating the pressure of the interior space (106) into the hollowed passage (138) and then into the firing assembly in the firing assembly recess (122). The firing assembly in the firing assembly recess (122) then ignites the detonation cord, which in turn detonates the perforated charges in the charge sockets as the detonation cord burns through the cavity. In FIG. 7, the hollowed passage (138) extends through the wall (104) from the firing assembly recess (122) beyond the burst disc (140) to the interchangeable end adapter (126*b*). The portion of the hollowed passage (138) to the left of the burst disc (140) in FIG. 7 is used to communicate fluid pressure through interior space (106) to the firing assembly recess (122). The portion of the hollowed passage (138) to the right of the burst disc (140) in FIG. 7 is the result of machining the hollowed passage (138) through the wall (104). After the passage (138) is machined, plug (142) is used to seal the passage (138) so that pressure from the interior space (106) is communicated to the firing assembly in recess (122). The portion of the hollowed passage (138) to the right of the burst disc (140) in FIG. 7 may not be present in embodiments where the passage (138) to the burst disc (140) is created by drilling from the firing assembly recess (122) on the left of FIG. 7.

The portion of the passage (138) of FIG. 7 that extends downward to the burst disc (140) from the top of the wall (104) is created by machining a hole from the top of the wall (104) to the interior space (106). The top of the passage (138) is capped by a plug (144). The burst disc (140) of FIG. 7 rests in the bottom of the passage (138), thereby creating a barrier between the passage (138) and the interior space (106) until the burst disc (140) ruptures due to an increase in the pressure differential between the passage (138) and the interior space (106).

In the example of FIG. 7, the wellbore subassembly (100) detonates the perforating charges using a fluid pressure signal in the form of an increase in pressure through the tubular string, and in turn the interior space (106), sufficient to rupture the burst disc (140) and actuate the firing head assembly. In this manner, the burst disc (140) operates as a hydraulic pressure valve that opens when the pressure differential reaches a certain predetermined threshold that is high enough to avoid accidental firing of the firing head assembly. Other structures and mechanisms for initiating detonation of the perforating charges as will occur to those of skill in the art may also be useful.

In other embodiments, an electrical conductor may be operatively connected to the firing assembly in the firing assembly recess (122). The electrical conductor may communicate an electrical signal from the surface to the firing assembly, which in turn initiates detonation of the perforating charges based on receipt of the signal.

In still other embodiments, the firing assembly may be operatively connected to a radio frequency receiver. The radio frequency receiver may receive a radio frequency signal originating from a well operator on the surface. In response to receiving the radio frequency signal, the radio frequency receiver may, in turn, transmit a detonation signal to the firing head assembly to initiate detonation of the perforating charges.

Fiber optic technology may also be useful for detonating the perforating charges, especially in formations where the magnetic characteristics of the formation reduce the reliability of the electric or radio frequency signaling. In such embodiments, the firing assembly may be operatively connected to a fiber optic receiver. The fiber optic receiver may receive a fiber optic signal originating from a well operator on the surface. In response to receiving the fiber optic signal, the fiber optic receiver may, in turn, transmit a detonation signal to the firing head assembly to initiate detonation of the perforating charges.

The example of FIG. 7 utilizes hydraulic pressure to initiate the detonation of the perforating charges. In other embodiments, however, pneumatic pressure values may be more appropriate. Such embodiments may operate similarly to the hydraulic version described with reference to FIG. 7. One or more pneumatic pressure values may be actuated by a pneumatic pressure signal. The pneumatic pressure values may communicate pneumatic pressure to the firing assembly to initiate detonation of the perforating charge in response to the pneumatic pressure signal. For example, the pneumatic pressure signal may be implemented as a certain threshold level of pneumatic pressure or a certain sequence of particular pressure levels.

Figure 8:
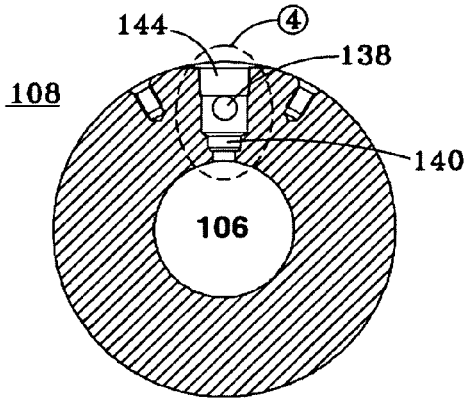
FIG. 8 sets forth a drawing illustrating 8-8 sectional view of the wellbore subassembly with perforating gun according to the embodiments of the present invention from FIG. 2.

For further explanation, FIG. 8 sets forth a drawing illustrating 8-8 sectional view of the wellbore subassembly (100) with perforating gun according to the embodiments of the present invention from FIG. 2. FIG. 8 depicts the burst disc (140) that operates as a barrier between interior space (106) and the hollowed passage (138). As mentioned above, the hollowed passage is formed to communicate fluid pressure from the interior space (106) to the firing assembly in the firing assembly recess. The burst disc (140) in example FIG. 8 is configured at the bottom of the hollow passage (138) and is capped off from the exterior space (108) using plug (144).

Figure 9:
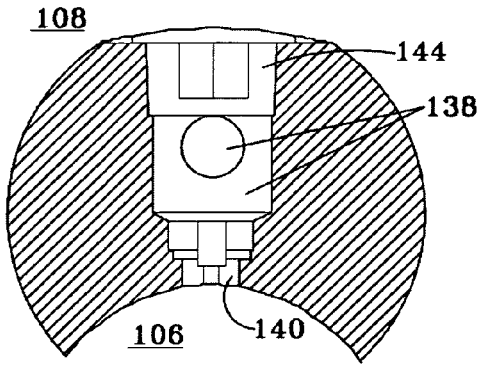
FIG. 9 sets forth a drawing illustrating a detailed view of region four of the 8-8 sectional view in FIG. 8.

FIG. 9 sets forth a drawing illustrating a detailed view of region four of the 8-8 sectional view in FIG. 8. FIG. 9 shows the burst disc (140) adjacent to and exposed to the interior space (106) of the tubular body. The burst disc (140) of FIG. 9 operates as a pressure barrier between the hollowed passage (138) and the interior space (106). FIG. 9 also illustrates the hollowed passage (138) used to communicate fluid pressure through the ruptured burst disc (140) to the firing head assembly in the firing assembly recess. As shown in FIG. 9, the hollowed passage (138) is blocked from the exterior space (108) by plug (144). When the pressure differential between interior space (106) and the hollowed passage (138) reaches an predetermined threshold the burst disc (140) ruptures, thereby communicating fluid pressure from interior space (106) into the hollowed passage (138). The hollowed passage (138) includes a circular channel that extends from the portion of the hollow passage (138) containing the burst disc (140) to the firing assembly recess in the wall of the tubular body. When the predetermined level of fluid pressure reaches the firing head assembly in the firing assembly recess, the firing assembly actuates to ignite the detonation cord, which in turn detonates the perforating charges.

Figure 10:
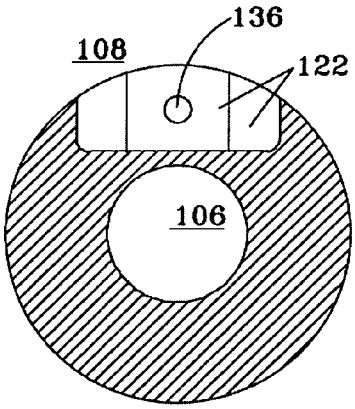
FIG. 10 sets forth a drawing illustrating the 10-10 sectional view of the wellbore subassembly with perforating gun according to the embodiments of the present invention of FIG. 2.

FIG. 10 sets forth a drawing illustrating the 10-10 sectional view of the wellbore subassembly (100) with perforating gun according to the embodiments of the present invention of FIG. 2. FIG. 10 depicts the firing assembly recess (122) that holds the firing head assembly. FIG. 10 also illustrates the hollowed passage (136) that connects the firing assembly recess (122) to the cavity. As mention above, the detonation cord that is configured along the cavity is connected to the firing head assembly in the firing assembly recess (122) through the hollowed passage (136).

Figure 11:
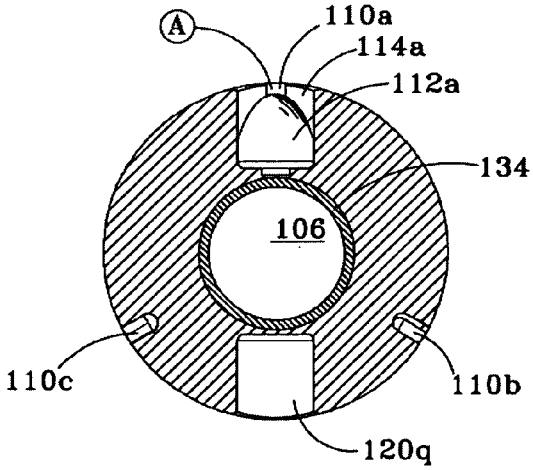
FIG. 11 sets forth a drawing illustrating the 11-11 sectional view of the wellbore subassembly with perforating gun according to the embodiments of the present invention of FIG. 2.

FIG. 11 sets forth a drawing illustrating the 11-11 sectional view of the wellbore subassembly (100) with perforating gun according to the embodiments of the present invention of FIG. 2. FIG. 11 illustrates the relative position of the different rows of the "S" shaped cavity (100) in which the perforating charges are configured. In FIG. 11, the first row of perforating charges is contained along the portion of the cavity designated as using reference number 110*a*; the second row of perforating charges is contained along the row of the cavity designated using reference number 110*b*; and the third row of the cavity containing perforated charges is designated using reference number 110*c*. Because the perforating charges in the cavity (110) are offset from one another so that no charge lies along the same sectional plane as another perforating charge, FIG. 11 only illustrates perforating charge (112*a*) in socket (114*a*).

As described in reference to FIG. 5, the perforating charge (112*a*) in the example of FIG. 11 detonates toward the interior space (106) and through the wall (104) at the location across from the interior space from the socket (114*a*), i.e., the wall target. In this manner, the perforating charge (112*a*) detonates toward and into the interior space (106) and through exist recess (120*q*) and into the exterior space (108). The detonation punctures the inner liner (134) as the discharge passes into and out of the interior space (106). During the detonation, however, the inner liner (134) helps to protect the other perforating charges in the other charge sockets along the tubular body from damage created by the forces generated as the perforating charge (112*a*) detonates.

Figure 12:
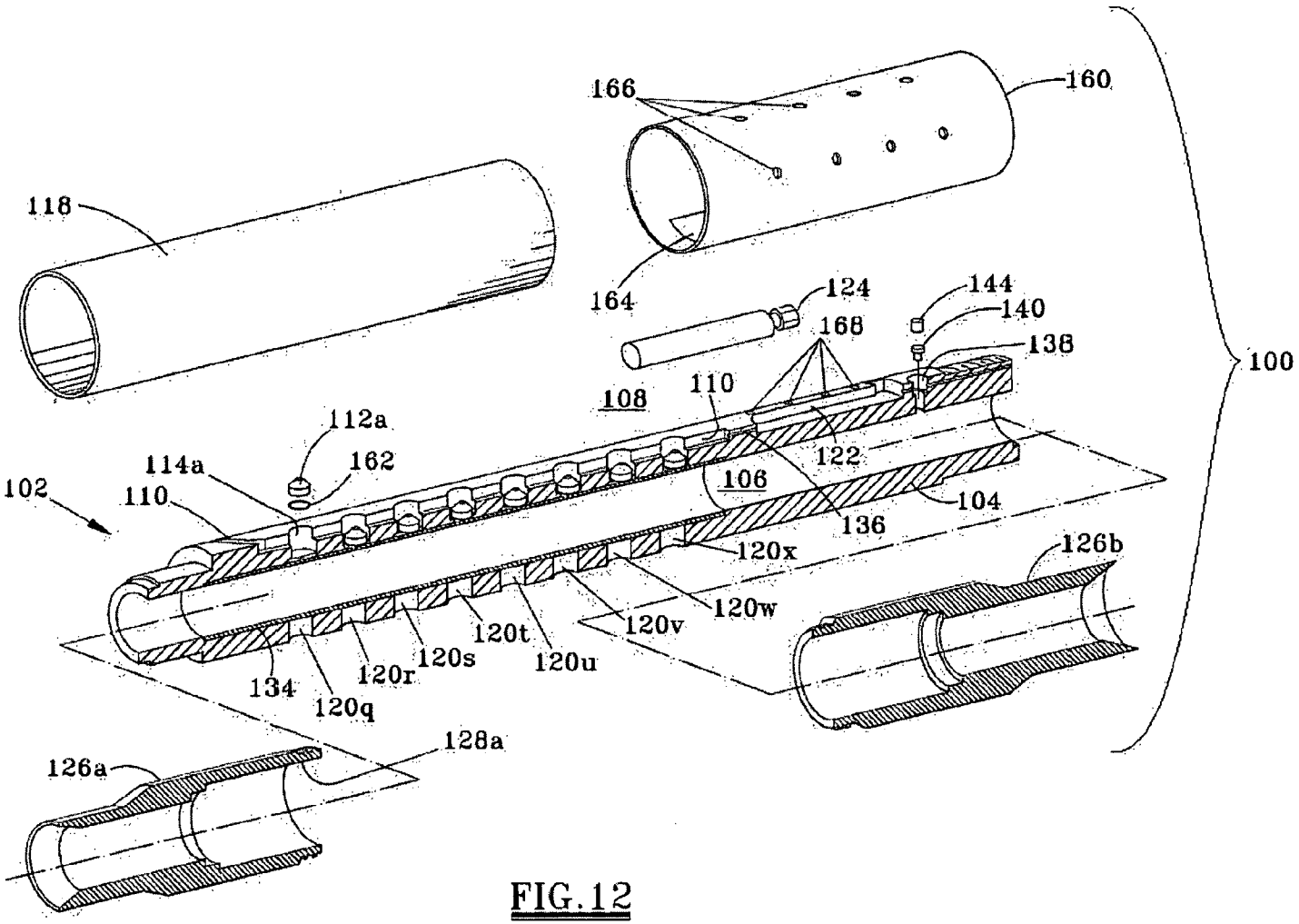
FIG. 12 sets forth a drawing illustrating an exploded view of the wellbore subassembly with perforating gun according to the embodiments of the present invention of FIG. 2.

Turning to FIG. 12, FIG. 12 sets forth a drawing illustrating an exploded view of the wellbore subassembly (100) with perforating gun according to the embodiments of the present invention of FIG. 2. FIG. 12 illustrates the various components utilized in the well bore subassembly (100). The wellbore subassembly (100) of FIG. 12 includes tubular body (102). The tubular body (102) of FIG. 12 has a wall (104) defining an interior space (106) and exterior space (108). The wall (104) has a cavity (110) that extends longitudinally along the length of the tubular body of (102) in the example of FIG. 12. The cavity (110) in FIG. 12 is configured in an "S" shaped pattern through the wall (104) to form three rows of charge sockets (114) longitudinally along the length of the tubular body (102). Each charge socket (114) receives only a single perforating charge (112), and a detonation cord runs through the cavity (110) along the tops of the perforating charges (112) in the charge sockets (114) of FIG. 12. In FIG. 12, the perforating charges (112) are held in place via gaskets. For example in FIG. 12, the perforating charge (112*a*) is secured in place in socket (114*a*) using o-ring (162).

The detonation cord that is configured along the tops of the perforating charges in the cavity (110) of FIG. 12 is ignited by a firing head assembly (124) configured in the firing assembly recess (122). The detonation cord connects to the firing head assembly (124) in the firing assembly recess (122) through a hollow passage (136) in the wall (104). In the example FIG. 12, the firing assembly (124) is configured longitudinally in the wall (104) of the tubular body (102). The firing assembly (124) is placed into the firing assembly recess (122) from the outside of the well bore subassembly (100). The firing assembly (124) of FIG. 12 is secured in place via a firing assembly sleeve (160). When installed on the tubular body (102), the firing assembly sleeve (160) of FIG. 12 rotates to expose the firing assembly recess (122) to the exterior space (108) via window (164). After the firing head assembly (124) is inserted into the firing assembly recess (122) in example FIG. 12, the firing assembly sleeve (160) is rotated so the window (164) is toward the bottom of the tubular body (102) and the wall of the firing assembly sleeve (160) protects the firing assembly (124) from conditions in the exterior space (108). The firing assembly sleeve (160) is held into place by eight screws inserted through holes (166) when the holes (166) of the firing assembly sleeve (160) line up with holes (168) in the tubular body (102). One skilled in the art will recognize that the firing assembly sleeve (160) of FIG. 12 is for example only and not for limitation.

In the example of FIG. 12, the firing assembly (124) is actuated based on a pressure signal received from the interior space (106). The firing assembly (124) of FIG. 12 operatively connects to interior space (106) through hollowed passage (138). The hollowed passage (138) of FIG. 12 is blocked from the interior space (106), however, by a burst disc (140). The burst disc (140) of FIG. 12 is ruptured when the pressure differential between the pressure of the interior space (106) exceeds the pressure in hollowed passage (138) by predetermined amount. When the predetermined pressure differential is reached, the burst disc (140) ruptures and the fluid pressure in the interior space (106) is communicated through the hollowed passage (138) to the firing assembly (124) in the recess (122). The fluid pressure from the interior space (106) is communicated to the firing assembly (124) in the recess (122) because the other open ends of the hollowed passage (138) are capped by plugs (142, 144).

Upon detonation of the firing head assembly (124), the detonation cord that extends along the cavity (110) begins igniting each perforating charge (112) in series. As each perforating charge ignites, pressure is created in the interior space (106) of FIG. 12. To prevent the pressure from the explosion of each charge from deforming the tubular body (102) near the cavity (110) containing the perforating charges, the tubular body (102) includes the inner liner (134). In this manner, the inner liner (134) in the example of FIG. 12 operates to reinforce the structural integrity of the tubular body (102).

The tubular body (102), in the example FIG. 12 also includes a removable outer layer (118). The removable outer layer (118) of FIG. 12 is a cylindrical shell that protects the perforated charges (112) from the exterior environment (108). The removable outer layer (118) of FIG. 12 is typically installed on the wellbore subassembly (100) after the perforated charges are configured inside the charge sockets along the cavity (110).

The tubular body in the example FIG. 12 includes interchangeable end adapters (126*a*) and (126*b*). Theses removable end adapters (126) allow the wellbore subassembly (100) to be installed in a variety of different tubular strings. Different wellbore strings may use different threads between components in a string. The use of interchangeable end adapters (126) allows the wellbore subassembly (100) to design the middle portion of the tubular body (102) with one interface that mates with all varieties of interchangeable end adapters. For example, in FIG. 12, the threads of the middle portion of the tubular body (102) at interface (128*a*) match the threads of the of the interchangeable end adapters (126*a*), and all interchangeable end adapters may be designed with the same thread specifications as the threads at interface (128*a*). In this manner, all interchangeable end adapters are capable of connecting to the middle portion of the tubular body (102). However, the interface of the interchangeable end adapters that allow the wellbore subassembly (100) to connect with the adjacent components of a tubular string may vary in size and shape from one end adapter to another to provide a way of connecting the wellbore subassembly (100) with a variety of tubular strings. Using the interchangeable end adapters, therefore, allows for the design and manufacture of one wellbore subassembly (100), with the exception of interchangeable end adapters, that can be installed in any tubular string.

In the example of FIG. 12, the firing assembly (124) is secured in the firing assembly recess (122) using a firing assembly sleeve (160). One skilled in the art, however, will recognize that other mechanisms for securing the firing head assembly in the firing assembly recess may also be useful such as, for example, using clamps.

Figure 13:
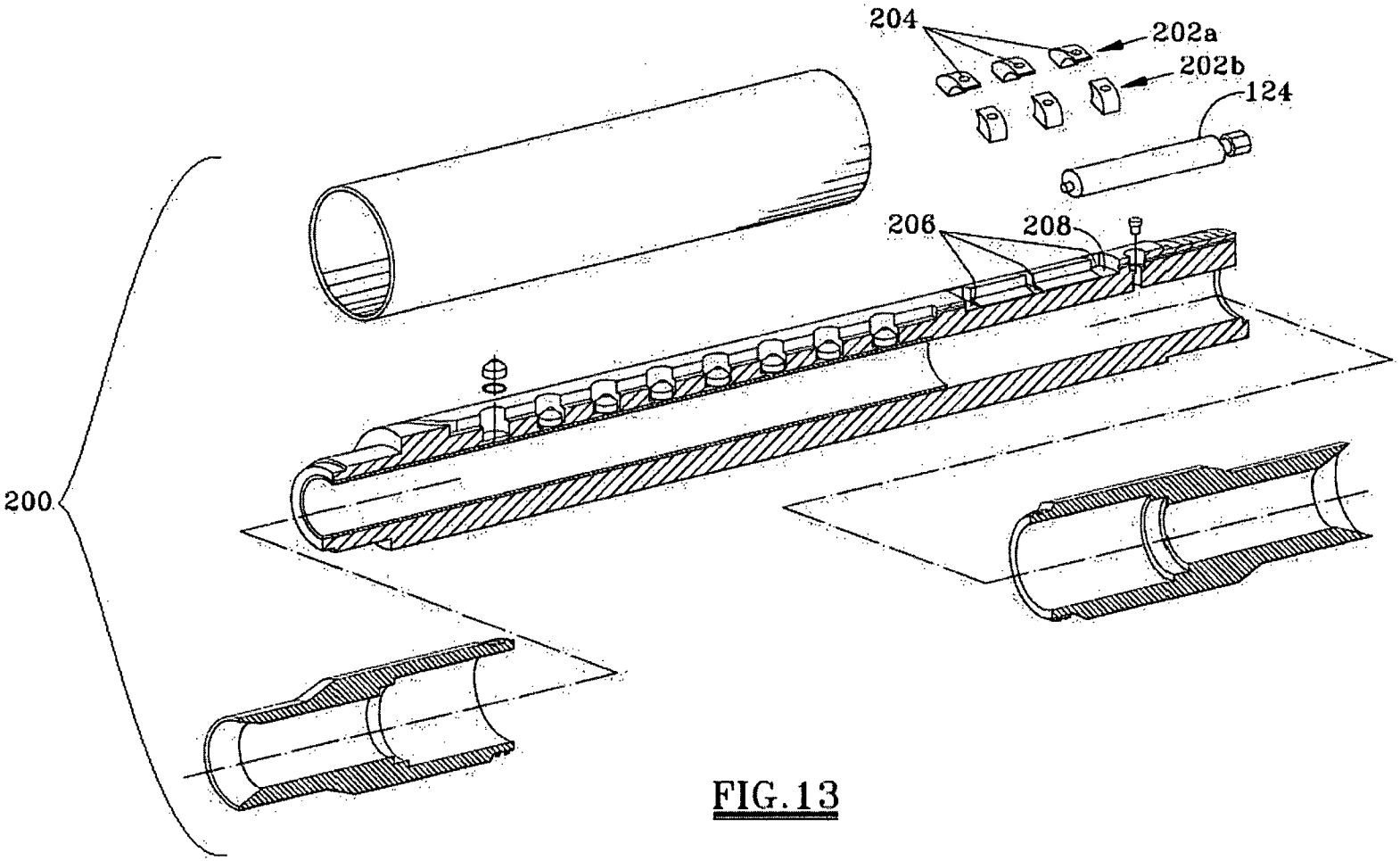
FIG. 13 sets forth a drawing illustrating a wellbore subassembly with perforating gun according to the embodiments of the present invention in which the firing assembly is secured within the firing assembly recess using clamps.

Accordingly, FIG. 13 sets forth a drawing illustrating a wellbore subassembly (200) with perforating gun according to the embodiments of the present invention in which the firing assembly is secured within the firing assembly recess using clamps (202). The wellbore subassembly (200) with perforating gun in example of FIG. 13 is similar to the wellbore subassembly (100) of FIG. 12. In the example of FIG. 13, however, the tubular body (102) includes clamps (202) that fit into slots (206) on the tubular body (102). The clamps (202) of FIG. 13 are secured by screws that pass through holes (204) securing the clamps (202) in slots (206). The firing assembly (124) of FIG. 13 is secured between the row of clamps labeled (202*a*) and the row of clamps labeled (202*b*) in the firing assembly recess (208).

Figure 14:
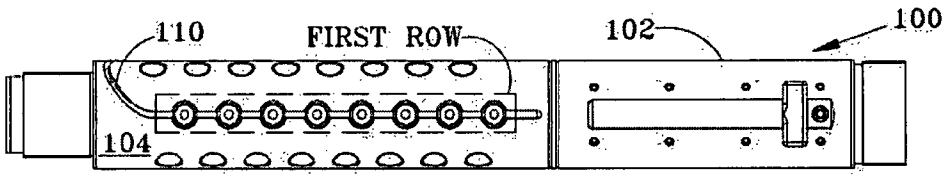
FIG. 14 sets forth a drawing illustrating a top orthogonal view of the wellbore subassembly with perforating gun according to the embodiments of the present invention without the interchangeable end adapters.

As mentioned above, the cavity in the wellbore subassembly (100) is configured using an "S" shaped pattern. FIGS. 14-18 illustrate the "S" shaped pattern of the cavity (110) in the wall of the tubular body (102) of the wellbore subassembly (100). The "S" shaped cavity (110) in FIGS. 14-18 form three rows of charge sockets. FIG. 14 sets forth a drawing illustrating a top orthogonal view of the wellbore subassembly (100) with perforating gun according to the embodiments of the present invention without the interchangeable end adapters. FIG. 14 depicts the first row of the charge sockets in the "S" shaped cavity (110). The "S" shaped cavity (110) through the wall (104) of FIG. 14 curves up clockwise on the left end of the tubular body (102) from the first row of charge sockets toward the second row of charge sockets not shown from the view of FIG. 14.

Figure 15:
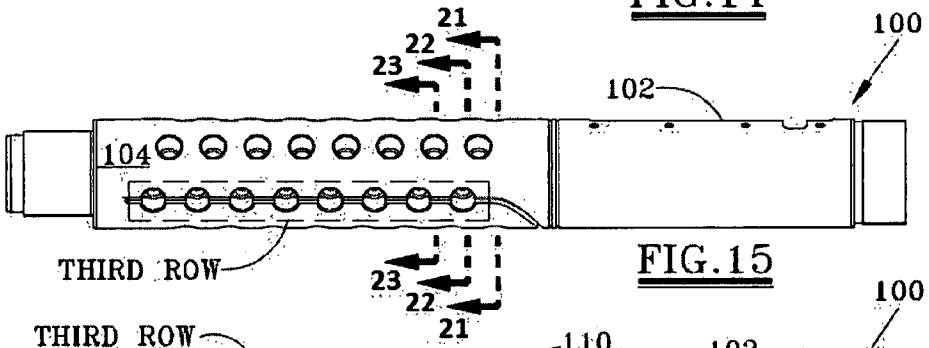
FIG. 15 sets forth a drawing illustrating the elevation view of the wellbore subassembly with perforating gun according to the embodiments of the present invention without the interchangeable end adapters.

FIG. 15 sets forth a drawing illustrating the elevation view of the wellbore subassembly (100) with perforating gun according to the embodiments of the present invention without the interchangeable end adapters. FIG. 15 depicts the third row of charged sockets formed by the cavity (110) inside the wall (104) of the tubular body (102). In FIG. 15, the "S" shaped cavity (110) through the wall (104) curves up counter-clockwise on the right end of the tubular body (102) toward the third row of charge sockets from the second row of charge sockets not shown from the view of FIG. 15.

Figure 16:
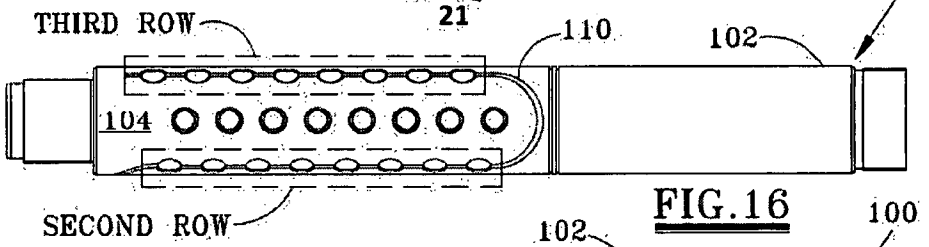
FIG. 16 sets forth a drawing illustrating the bottom view of the wellbore subassembly with perforating gun according to the embodiments of the present invention without the interchangeable end adapters.

FIG. 16 sets forth a drawing illustrating the bottom view of the wellbore subassembly (100) with perforating gun according to the embodiments of the present invention without the interchangeable end adapters. FIG. 16 illustrates both the second and third rows of the charge sockets formed by the cavity (110) inside the wall (104) of the tubular body (102). In FIG. 16, the "S" shaped cavity (110) through the wall (104) curves up clockwise on the left end of the tubular body (102) and extends toward the right end of the tubular body (102) to form the second row of charge sockets. The "S" shaped cavity (110) then curves up counter-clockwise on the right end of the tubular body (102) and extends toward the left end of the tubular body (102) to form the third row of charge sockets.

Figure 17:
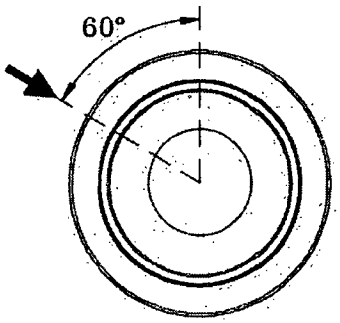
FIG. 17 sets forth a drawing illustrating the right view of the wellbore subassembly with perforating gun according to the embodiments of the present invention without the interchangeable end adapters.

FIG. 17 sets forth a drawing illustrating the right view of the wellbore subassembly (100) with perforating gun according to the embodiments of the present invention without the interchangeable end adapters. FIG. 17 includes a directional arrow identified in FIG. 17 as the "path view." The path view is essentially the top view of the wellbore subassembly (100) rotated sixty degrees to provide a view that includes both the first and second row of charge sockets.

Figure 18:
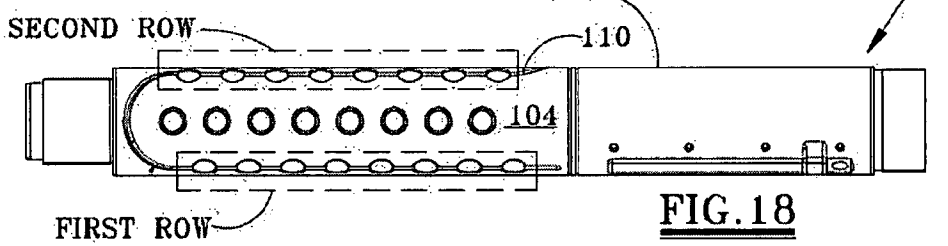
FIG. 18 sets forth a drawing illustrating the path view the wellbore subassembly with perforating gun according to the embodiments of the present invention without the interchangeable end adapters.

FIG. 18 sets forth a drawing illustrating the path view the wellbore subassembly (100) with perforating gun according to the embodiments of the present invention without the interchangeable end adapters. FIG. 18 depicts the first and second rows of charge sockets formed by the cavity (110) inside the wall (104) of the tubular body (102). In FIG. 18, the "S" shaped cavity (110) begins at the right end of the tubular body (102) and extends toward the left end of the tubular body (102) to form the first row of charge sockets. The "S" shaped cavity (110) then curves up clockwise on the left end of the tubular body (102) and extends toward the right end of the tubular body (102) to form the second row of charge sockets. The "S" shaped cavity (110) then curves up counter-clockwise on the right end of the tubular body (102) toward the third row of charge sockets not shown from the view of FIG. 18.

Figure 19:
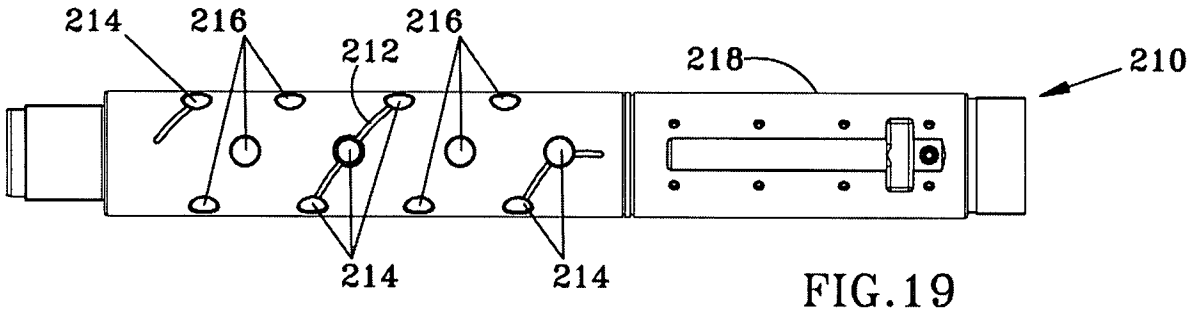
FIG. 19 sets forth a drawing illustrating a top orthogonal view of an additional wellbore subassembly with perforating gun according to embodiments of the present invention.

While FIGS. 14-18 illustrate a cavity configured in an "S" shaped pattern within the wall of the wellbore subassembly with perforating gun according to embodiments of the present invention, the cavity may be configured in other ways as will occur to those of skill in the art. Consider, for example, the cavity of FIGS. 19 and 20. FIG. 19 sets forth a drawing illustrating a top orthogonal view of a wellbore subassembly (210) with perforating gun according to embodiments of the present invention. In FIG. 19, the removable outer layer is not shown in order to expose the cavity (212). The cavity (212) of FIG. 19 is configured in a spiral pattern within and along the wall of the tubular body (218). In the example of FIG. 19, the cavity (212) is shaped to define charge sockets (214), and each charge socket (214) receives only a single perforating charge. In the example of FIG. 19, the tubular body (218) also includes exit cavities (216). Similar to the charge sockets (214), these exit cavities (216) of FIG. 19 are also configured in a spiral pattern longitudinally along the tubular body (218).

Figure 20:
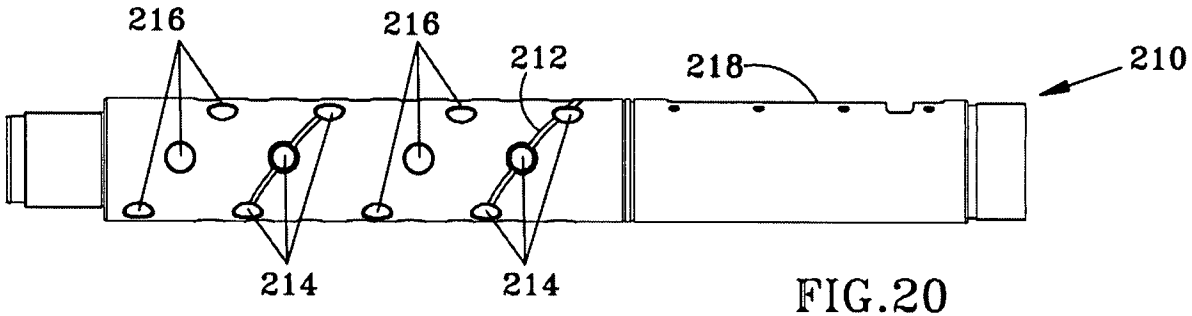
FIG. 20 sets forth a drawing illustrating an elevation view of the additional wellbore subassembly with perforating gun according to embodiments of the present invention.

FIG. 20 sets forth a drawing illustrating an elevation view of the wellbore subassembly (210) with perforating gun according to embodiments of the present invention. The view of FIG. 20 depicts certain portions of the cavity (212) and certain exit cavities (216) that are not visible in FIG. 19. That is, FIG. 20 continues to illustrate the spiral shaped pattern formed from the cavity (212) and sockets (212), as well as the exit cavities (216). One of skill in the art will note that the "S" shaped and spiral shaped cavities described herein are for explanation only, not for limitation. A wellbore subassembly according to embodiments of the present invention may utilize cavities shaped in any pattern as will occur to those of skill in the art. Further, one of skill in the art will note that, while the exemplary wellbore assemblies according to embodiments of the present invention described herein utilize only a single cavity to form the "S" shaped pattern or the spiral pattern, this is for explanation only and not for limitation. In fact, a wellbore subassembly according to embodiments of the present invention may utilize any number of cavities.

Figure 21:
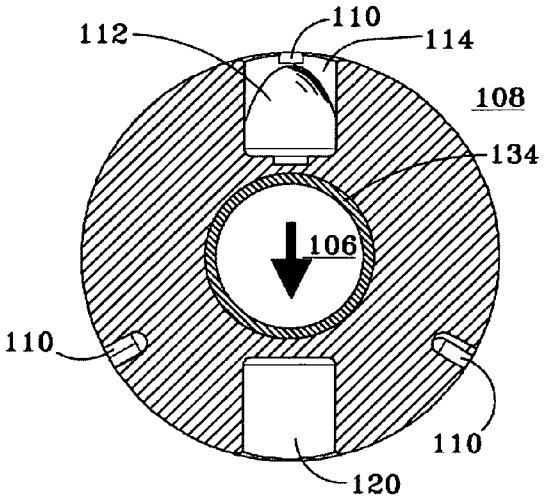
FIG. 21 sets forth a drawing illustrating the E-E sectional view of the wellbore subassembly with perforating gun according to the embodiments of the present invention of FIG. 15.
Figure 22:
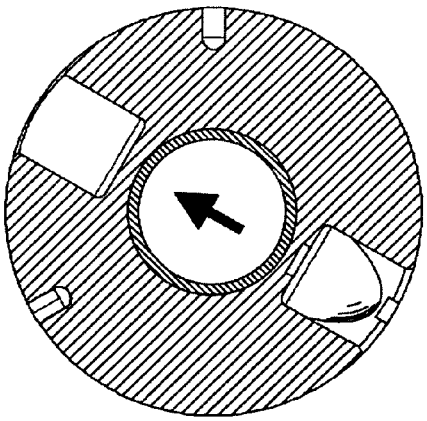
FIG. 22 sets forth a drawing illustrating the F-F sectional view of the wellbore subassembly with perforating gun according to the embodiments of the present invention of FIG. 15.
Figure 23:
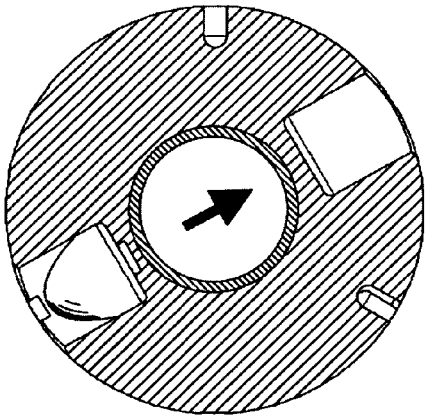
FIG. 23 sets forth a drawing illustrating the G-G sectional view of the wellbore subassembly with perforating gun according to the embodiments of the present invention of FIG. 15.

FIGS. 21 through 23 show cross sections of the tubular body (102) of the wellbore subassembly (100) of FIG. 15. FIG. 21 sets forth a drawing illustrating the E-E sectional view of the wellbore subassembly (100) with perforating gun according to the embodiments of the present invention of FIG. 15. FIG. 21 depicts a perforating charge (112) configured in the charge socket (114) from the first row of charge sockets in cavity (110) from FIG. 15. Perforating charge (112) discharges toward the interior space (106) through the inner liner (134) and penetrates into the exterior space (108) through the inner liner (134) and exit recess (120) by perforating the wall (104) across the interior space (106) from the location of the perforating charge (112). In perforating the wall (104) across the interior space (106) from the location of the perforating charge (112), the discharge from the perforating charge (112) punctures the inner liner (134) as it passes through exit recess (120) into the exterior space (108). In this manner, the perforating charge (112) in FIG. 21 discharges along the arrow shown in FIG. 21.

As noted above with reference to FIG. 15, FIG. 21 does not depict the removable outer layer (118). The removable outer layer secures the perforating charge (112) in the socket (114) and protects the perforating charge (112) from conditions in the exterior space (108). Upon discharge, the perforating charge (112) also punctures the removable outer layer at the location of the exit recess (120).

FIG. 22 sets forth a drawing illustrating the F-F sectional view of the wellbore subassembly (100) with perforating gun according to the embodiments of the present invention of FIG. 15. FIG. 22 depicts a perforating charge (112) in a charge socket (114) formed in the second row of the cavity (110). Similar to the perforating charge (112) in FIG. 21, the perforating charge in FIG. 22 is configured to discharge toward the interior space and penetrate into the exterior space by perforating the wall across from the interior space from location of the perforating charge (112). That is, the perforating charge in FIG. 22 discharges along the arrow shown in FIG. 22 through the inner liner (134), the exit cavity (120), and the removable outer layer (not shown) in FIG. 22.

FIG. 23 sets forth a drawing illustrating the G-G sectional view of the wellbore subassembly (100) with perforating gun according to the embodiments of the present invention of FIG. 15. FIG. 23 depicts a perforating charge (112) in a charge socket (114) formed in the third row of the cavity (110). Similar to the perforating charge (112) in FIG. 21, the perforating charge in FIG. 23 is configured to discharge toward the interior space and penetrate into the exterior space by perforating the wall across from the interior space from location of the perforating charge (112). That is, the perforating charge in FIG. 23 discharges along the arrow shown in FIG. 23 through the inner liner (134), the exit cavity (120), and the removable outer layer (not shown) in FIG. 23.

FIGS. 21-23 illustrate the exit cavities (120) corresponding to the charge sockets (114). The exit cavity (120) can have therein or associated therewith an accelerator or performance enhancer to provide a cleaner perforation tunnel, as well as a longer, bigger and better defined fraction or perforation. The accelerator or performance enhancer can be any appropriate stimulator, such as for example, a jet fuel product. Further, the accelerator or performance enhancer can be in any form, such as for example, a solid, liquid, wax or combinations thereof. Such an accelerator or performance enhancer can be built into the exit cavity (120), can be placed in the exit cavity (120), or associated with the exit cavity (120) so as to provide a cleaner perforation tunnel, as well as a longer, bigger and better defined fraction or perforation.

It has been found that the configuration of the charge socket (114), the interior space (106) and the exit cavity (120) creates a focused discharge that greatly enhances the resulting explosive characteristics. There is a volume of gas and air that expands when the charges (112) ignite. This natural expansion of gas and air provides additional explosive characteristics.

Further, it has been found that the structure and/or configuration of the charge socket (114) enhances the explosive characteristics associated with the present disclosure. The structure and/or configuration of the charge socket (114) confines the explosive charge characteristics thereby increasing the charge performance.

Figure 24:
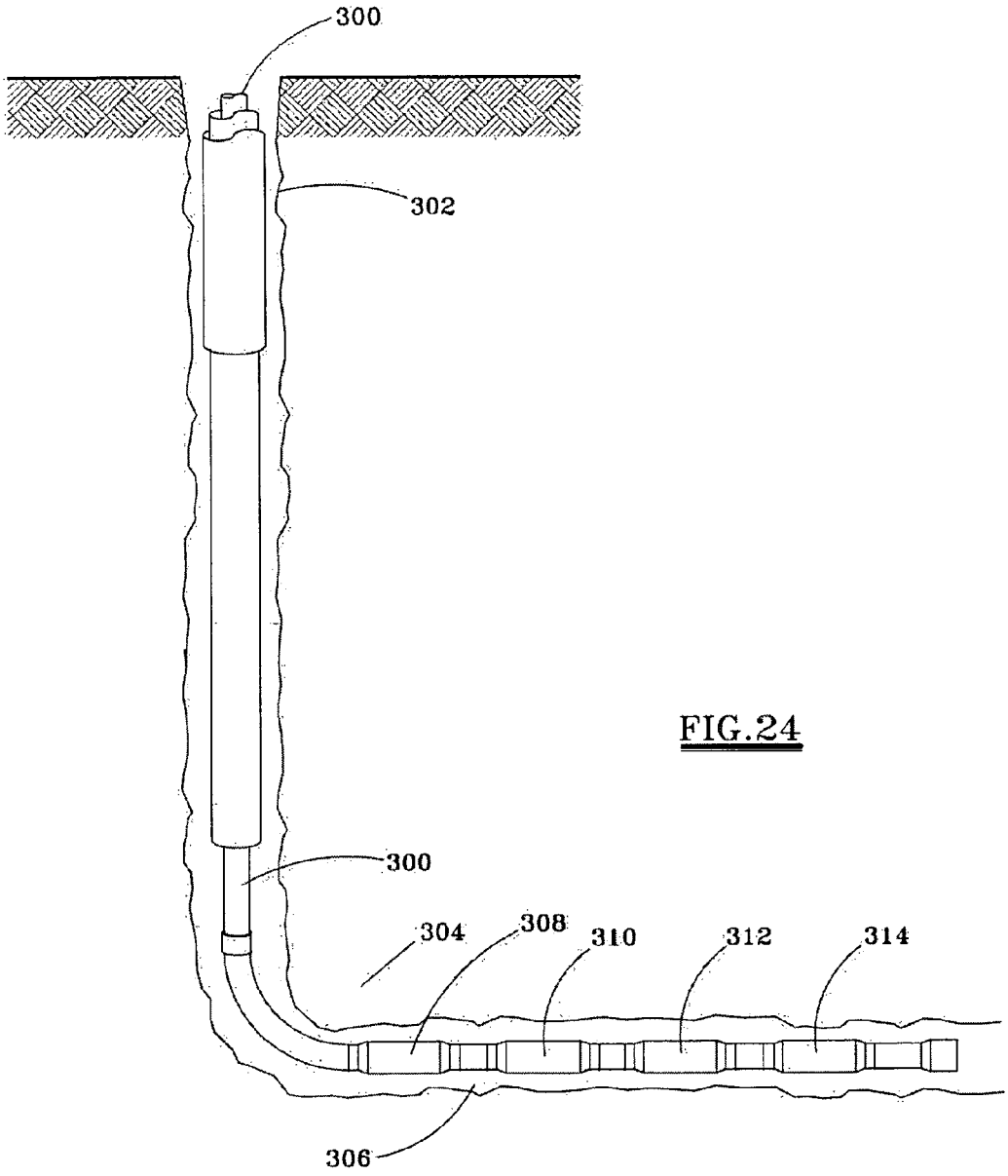
FIG. 24 sets forth a drawing illustrating several wellbore subassemblies with perforating guns according to the embodiments of the present invention that are conveyed along a casing string of a horizontal well.

As previously mentioned, the wellbore subassembly with perforating gun according to embodiments of the present invention is conveyed through a wellbore as part of a tubular string. For further explanation, FIG. 24 sets forth a drawing illustrating several wellbore subassemblies (308, 310, 312, 314) with perforating guns according to the embodiments of the present disclosure that are conveyed along a casing string of a horizontal well. FIG. 24 depicts a casing string (300) conveyed through a bore hole (302) that penetrates and turns through a geological formation (304). In the example of FIG. 24, the casing string (300) is secured in the bore hole (302) using cement (306), which is optional. The casing string (300) in FIG. 24 includes four wellbore subassemblies (308, 310, 312, 314) with perforating guns according to the embodiments of the present invention. The perforating charges in the each of the wellbore subassemblies (308, 310, 312, 314) may be detonated individually or concurrently together in a group. Upon detonation of the perforating charges in one of the wellbore subassemblies (308, 310, 312, 314), the perforating charges puncture the optional concrete (306) annulus surrounding the casing string (300) and penetrate into the formation (304) at a point adjacent to the respective wellbore subassembly. After the perforations have been created in the formation (304), fracing or other completion processes may be used to prepare the well for extraction of hydrocarbons in the adjacent areas of the formation (304).

The arcuate and lateral portions of the borehole (302) create specific problems, especially with respect to perforating. However, these problems are resolved with the use of the apparatus and methods of the present disclosure. Further, the longer the lateral portions of the borehole (302), the more difficult it is to achieve effective perforations. Not so with the use of the apparatus and methods of the present disclosure. Thus, as drilling practices are directed more toward directional drilling, and directional drilling creates more and longer lateral well bores, the need for the effective perforating techniques as defined in the present disclosure increase.

The perforating apparatus and methods defined in this disclosure provide enhanced perforating characteristics because of the structure of the apparatus. The present perforating apparatus and methods do not require secondary control lines that extend to the surface, and are easy to install and use. The present perforating apparatus and methods result in a truly "disappearing" perforating gun that is unobtrusive after it has been used.

The characteristics of the perforation achieved by the present disclosure are greatly enhanced. Particularly, the achievement of a continuous, normal perforation, free from disruption, has been achieved. The perforating apparatus and methods defined in this disclosure use existing charges to enhance the capacity and forcefulness of the perforation. Still further, the present perforating apparatus and methods reduce the costs, are less time consuming, reduce the manpower needs and is significantly less prone to safety problems.

While certain exemplary embodiments have been described in details and shown in the accompanying drawings, it is to be understood that such embodiments are merely illustrative of and not devised without departing from the basic scope thereof, which is determined by the claims that follow.

We claim:

1. A method of perforating a geological formation adjacent to a wellbore, the method comprising:

conveying a tubular string through a wellbore, the tubular string comprising a tubular body having a wall defining an interior bore extending longitudinally through the tubular body and an exterior space, the wall comprising a cavity, the cavity configured with a perforating charge at a first location inside the wall;

detonating the perforating charge; and perforating, in response to the detonation, inwardly through the wall between the perforating charge and the interior bore and then continuing through the interior bore and the wall into the exterior space at a second location across the interior bore from the first location of the perforating charge.

2. The method of claim 1 wherein perforating outwardly through the wall into the exterior space further comprises perforating the geological formation.

3. The method of claim 1 wherein detonating the perforating charge further comprises:

transmitting an electrical signal from a surface above the wellbore to the tubular body;

and detonating the perforating charge in dependence upon the electrical signal.

4. The method of claim 1 wherein detonating the perforating charge further comprises:

transmitting a radio frequency signal from a surface above the wellbore to the tubular body and detonating the perforating charge in dependence upon the radio frequency signal; or transmitting an optical signal from a surface above the wellbore to the tubular body and detonating the perforating charge in dependence upon the optical signal; or transmitting a pneumatic pressure signal from a surface above the wellbore to the tubular body and detonating the perforating charge in dependence upon the pneumatic pressure signal; or combinations thereof.

5. The method of claim 1 wherein detonating the perforating charge further comprises: transmitting an fluid pressure signal from a surface above the wellbore to the tubular body; and detonating the perforating charge in dependence upon the fluid pressure signal.

* * * * *

UNITED STATES PATENT AND TRADEMARK OFFICE

CERTIFICATE OF CORRECTION

PATENT NO. : 8,622,132 B2
APPLICATION NO. : 12/804517
DATED : January 7, 2014
INVENTOR(S) : Mytopher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 531 days.

Signed and Sealed this
Nineteenth Day of May, 2015

Michelle K. Lee

Michelle K. Lee
*Director of the United States Patent and Trademark Office*